US007207258B1

(12) United States Patent
Scanlon

(10) Patent No.: US 7,207,258 B1
(45) Date of Patent: Apr. 24, 2007

(54) WEAPON SILENCERS AND RELATED SYSTEMS

(75) Inventor: Michael V. Scanlon, Laurel, MD (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/009,855

(22) Filed: Dec. 10, 2004

(51) Int. Cl.
*F41A 21/00* (2006.01)

(52) U.S. Cl. ..... 89/198; 89/14.4; 181/223

(58) Field of Classification Search ..... 89/14.3, 89/14.4; 181/212, 247, 249
See application file for complete search history.

(56) References Cited

U.S. PATENT DOCUMENTS

| | | | | | |
|---|---|---|---|---|---|
| 2,916,970 | A | * | 12/1959 | Mutter | 89/14.3 |
| 4,222,456 | A | | 9/1980 | Kasper | 181/296 |
| 4,291,610 | A | | 9/1981 | Waiser | 89/14 |
| 4,315,560 | A | | 2/1982 | Stauch et al. | 181/275 |
| 4,335,644 | A | | 6/1982 | Goes et al. | 89/198 |
| 4,576,083 | A | | 3/1986 | Seberger, Jr. | 89/14.4 |
| 4,584,924 | A | | 4/1986 | Taguchi | 89/14.4 |
| 4,588,043 | A | | 5/1986 | Finn | 181/223 |
| 4,685,534 | A | | 8/1987 | Burstein et al. | 181/251 |
| 4,974,489 | A | | 12/1990 | Fishbaugh | 89/14.4 |
| 5,164,535 | A | | 11/1992 | Leasure | 89/14.4 |
| 5,311,907 | A | | 5/1994 | Houck | 137/810 |
| 5,315,914 | A | | 5/1994 | Schumacher | 89/14.05 |
| 5,679,916 | A | | 10/1997 | Weichert | 89/14.4 |

FOREIGN PATENT DOCUMENTS

| | | | | |
|---|---|---|---|---|
| FR | 0866587 | * | 8/1941 | 89/14.4 |

* cited by examiner

*Primary Examiner*—Michael J. Carone
*Assistant Examiner*—Gabriel J. Klein
(74) *Attorney, Agent, or Firm*—William V. Adams

(57) ABSTRACT

Silencers are provided for a weapon having a combustion chamber and a barrel. The weapon is configured to launch a projectile with combustion gases generated in the combustion chamber. An exemplary silencer includes a proximal end and a distal end, the proximal end being configured for mounting the silencer to the barrel, the distal end being configured to allow the projectile to pass therethrough, and at least one vortex chamber disposed between the proximal end and the distal end. The at least one vortex chamber includes a circular peripheral wall for inducing a vortex on a portion of the combustion gases expelled from the combustion chamber during launch of the projectile. The vortex impedes flow of the combustion gases from the barrel such that acoustic energy associated with the launch of the projectile is dissipated.

5 Claims, 6 Drawing Sheets

WEAPON SILENCERS AND RELATED SYSTEMS

GOVERNMENT INTEREST

The invention described herein may be manufactured, used, and licensed by or for the United States Government.

BACKGROUND

1. Technical Field

The present disclosure generally relates to silencers for weapons having combustion chambers.

2. Description of the Related Art

Many known weapons utilize expanding high-pressure combustion gases to expel a projectile from the weapon. For example, to "fire" a bullet from a firearm, gun powder is ignited behind the bullet. Ignition of the gun powder creates a high-pressure pulse of combustion gases that forces the bullet down the barrel of the firearm. When the bullet exits the end of the barrel, the high-pressure pulse of combustion gases exits the barrel as well. The rapid pressurization and subsequent depressurization caused by this high-pressure pulse creates a loud sound known as "muzzle blast." As would be expected, the muzzle blast can indicate to an observer the direction from which a weapon is being fired. There are those occasions, such as during law enforcement operations or military operations, when it is desirable to conceal the location from which a weapon is fired. In those instances, it is often desirable to reduce the amplitude of the muzzle blast.

The use of silencers with weapons to reduce the amplitude of muzzle blasts is known. A typical silencer is located on the end of the barrel and provides a large expansion volume compared to the barrel, typically 20 to 30 times greater. With the silencer in place, the pressurized combustion gases behind the projectile have a relatively large volume into which to expand. As the combustion gases expand into the volume of the silencer, the pressure of those gases falls significantly. Therefore, as the projectile finally exits the silencer, the pressure of the combustion gases being released to the atmosphere is significantly lower than the pressure of the combustion gases when a silencer is not used. By reducing the peak amplitude of the combustion gas pressure released to the atmosphere, the sound of the weapon being fired is much softer.

Many existing silencers are typically of complex construction. For example, many silencers have moving parts and tight variances that may become fouled by residue deposited as combustion gases pass through the silencer. Fouling of these parts and variances during the repeated firing of the weapon may cause reduced efficiency and/or total inoperability of the silencer. Many existing silencers also require the use of baffling materials for the reduction of the muzzle blast of the weapon. Often, these baffling materials must be replaced frequently during repetitive firing to maintain the effectiveness of the silencer.

SUMMARY

Briefly described, devices and systems involving a silencer for use with a weapon are disclosed. A representative embodiment of a silencer is provided for a weapon that has a combustion chamber and a barrel. The weapon is configured to emit a projectile with combustion gases. The silencer also includes a proximal end and a distal end, the proximal end being configured for mounting the silencer to the barrel, the distal end being configured to allow the projectile to pass therethrough. The silencer includes at least one vortex chamber disposed between the proximal end and the distal end, the at least one vortex chamber including a circular peripheral wall for inducing a vortex on a portion of the combustion gases during emission of the projectile.

Another embodiment provides a weapon for emitting a projectile with combustion gases. The weapon includes a combustion chamber, a barrel for guiding the projectile along a flight path, and a silencer. The silencer includes a proximal end and a distal end, the proximal end being configured for mounting the silencer to the barrel, the distal end being configured to allow the projectile to pass therethrough, and at least one vortex chamber disposed between the proximal end and the distal end. The at least one vortex chamber includes a circular peripheral wall for inducing a vortex on a portion of the combustion gases during emission of the projectile.

Other systems, methods, features and/or advantages will be or may become apparent to one with skill in the art upon examination of the following drawings and detailed description. It is intended that all such additional systems, methods, features and/or advantages be included within this description and be protected by the accompanying claims.

BRIEF DESCRIPTION OF THE DRAWINGS

The components in the drawings are not necessarily to scale. Moreover, in the drawings, like reference numerals designate corresponding parts throughout the several views.

DETAILED DESCRIPTION

Figure 1:
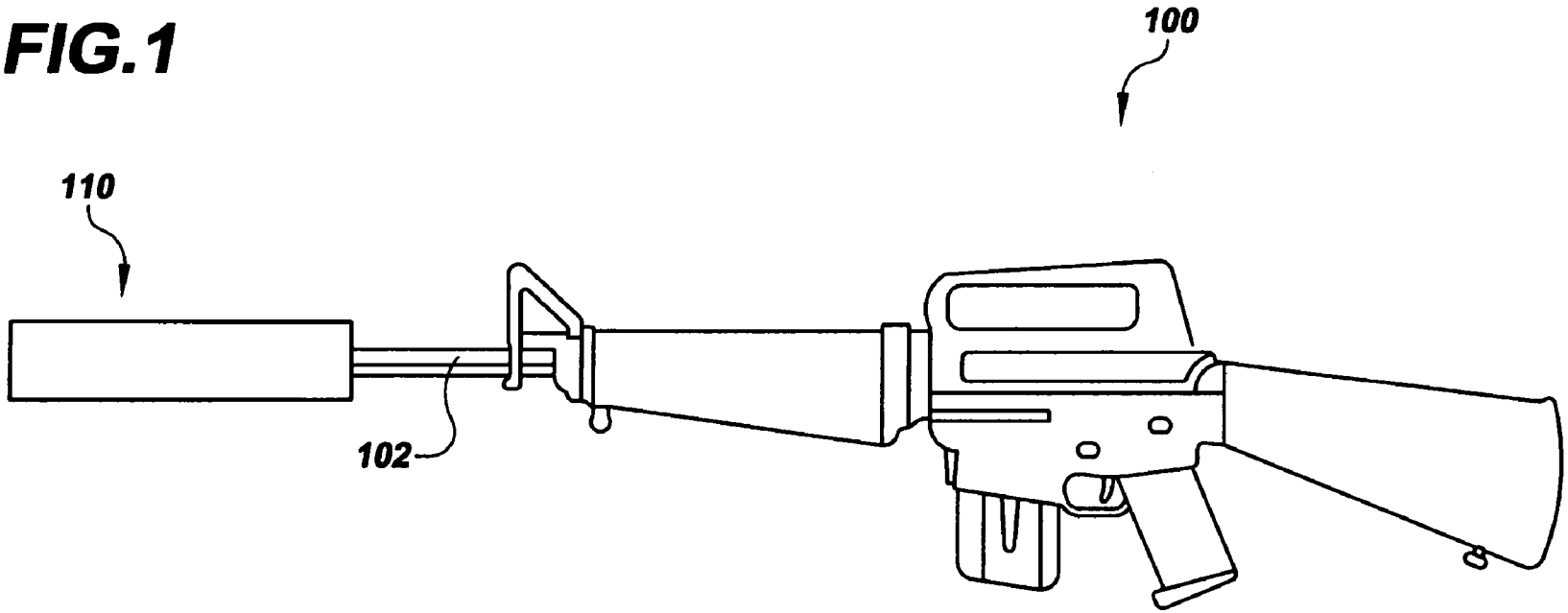
FIG. 1 is a side view of an embodiment of a weapon that includes an embodiment of a silencer.
Figure 2A:
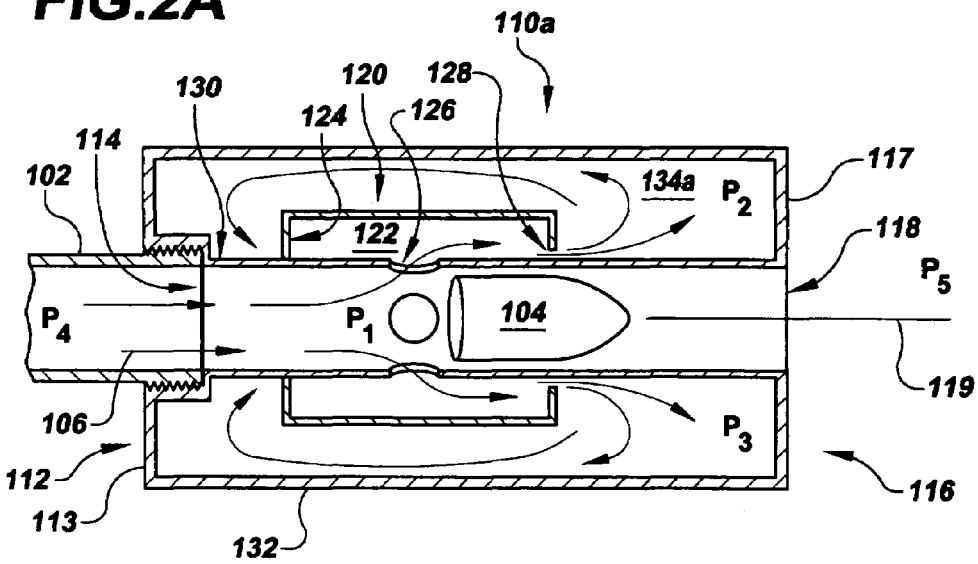
FIGS. 2A and 2B are cut-away side views of an embodiment of a silencer.
Figure 2B:
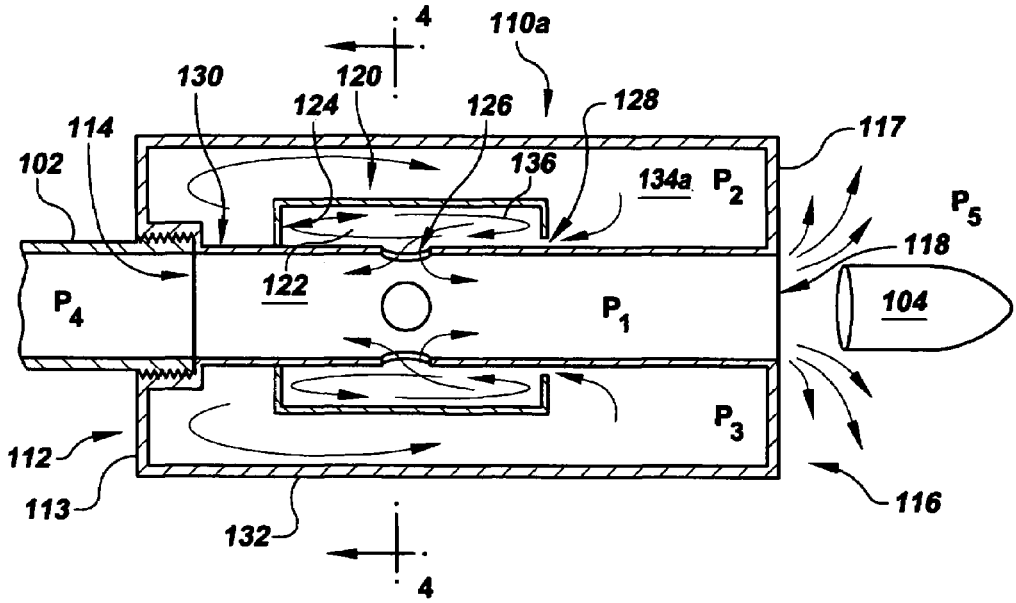
Figure 3A:
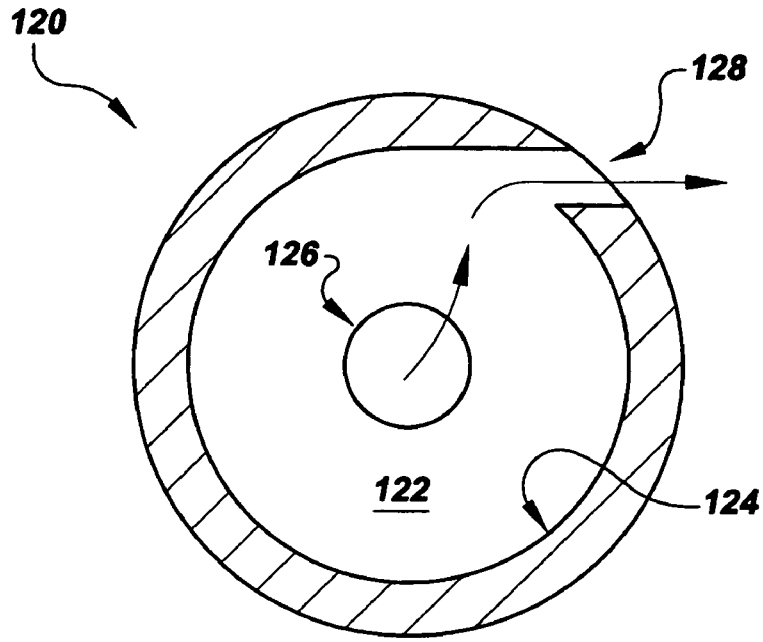
FIGS. 3A and 3B are schematic illustrations of an embodiment of a vortex chamber showing internal fluid flow.
Figure 3B:
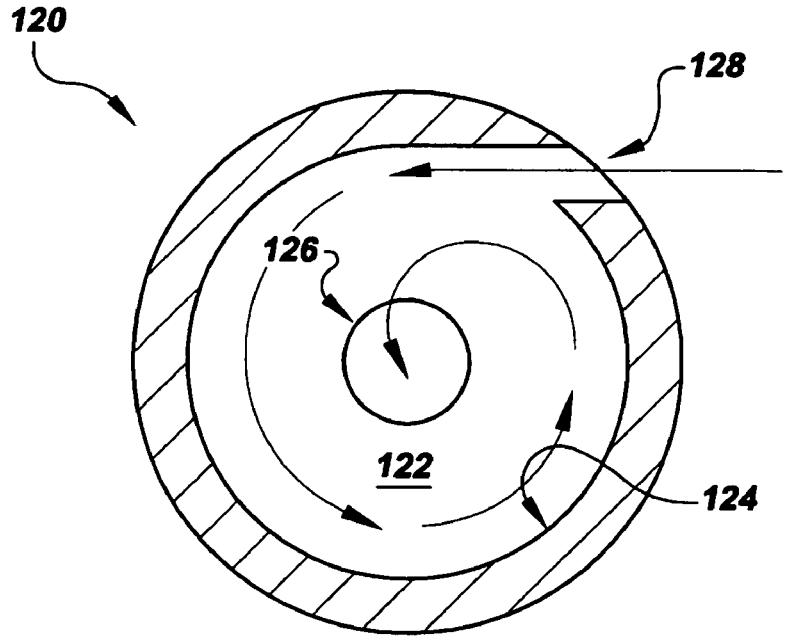
Figure 4:
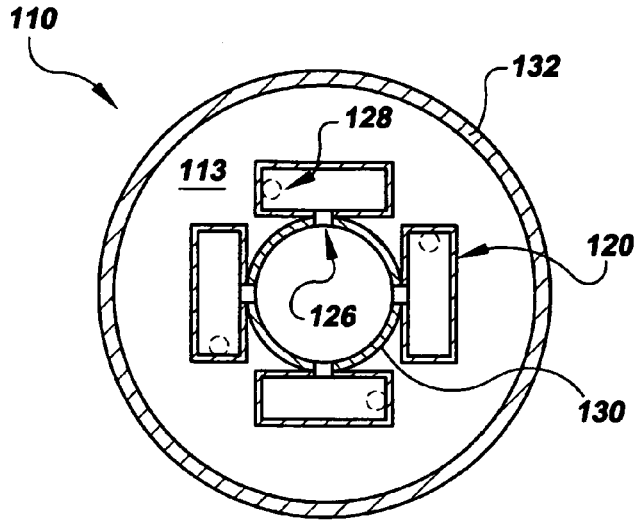
FIG. 4 is a cross-sectional view of the silencer as shown in FIGS. 2A and 2B, along line 4—4 of FIG. 2B.

Embodiments of silencers for reducing the muzzle blast of a weapon are discussed. FIG. 1 depicts an exemplary embodiment of a silencer as would be disposed on a weapon. FIGS. 2A–2B and 4 depict an exemplary embodiment of a silencer of the disclosure. The principles of operation of an embodiment of a vortex diode are depicted in FIGS. 3A–3B. The remaining figures depict other exemplary embodiments of silencers.

Referring now to FIG. 1, an embodiment of a weapon 100 is depicted to which an embodiment of a silencer 110 is attached. Specifically, the silencer 110 is attached to the barrel 102 of the weapon 100. Although the weapon 100 is a rifle-type firearm, embodiments of silencers may be used with other types of weapons, such as hand guns.

FIGS. 2A and 2B depict another embodiment of a silencer. As shown, the silencer 110*a* includes a proximal end 112 including an entry opening 114, and a distal end 116 including a discharge opening 118. Preferably, the proximal end 112 is configured to be removably attached to the end of the barrel of a weapon, such as barrel 102 of FIG. 1. By way of example, matching threads are preferably used. The longitudinal axis of the barrel 102 and the silencer 110*a* form a single longitudinal axis, or projectile path 119. Preferably, an inner cylindrical wall 130 extends from the entry opening 114 to the discharge opening 118 about the projectile path 119. An outer housing 132 is disposed about the inner cylindrical wall 130, thereby forming an expansion chamber 134*a*. Preferably, although not necessarily, the proximal end 112 and distal end 116 of the silencer 110*a* are formed by a first wall 113 and a second wall 117, respectively, that are substantially parallel. As such, the first wall 113, the second wall 117, the inner cylindrical wall 130, and the outer housing 132 form a cylindrical expansion chamber 134*a*. Preferably, materials used in constructing the silencer have desirable heat conduction/absorption properties to help remove energy from the expanding combustion gases.

Preferably, the silencer 110*a* includes a plurality of vortex diodes 120 disposed on the inner cylindrical wall 130 (FIG. 4). Each vortex diode 120 includes a circular peripheral wall 124 defining a substantially cylindrical vortex chamber 122, a vent 126, and a nozzle 128 formed in the circular peripheral wall 124.

As shown in FIG. 3A, the circular peripheral wall 124 is disposed about the vent 126 and the nozzle 128 is formed tangential to the circular peripheral wall 124. Embodiments are envisioned wherein multiple nozzles 128 are positioned at various points around the circular peripheral wall 124, each providing a tangential input to the chamber. As such, combustion gases, flowing in the direction of the flow arrows, enter the vortex diode 120 through the vent 126 and pass through the vortex chamber 122 directly out the nozzle 128. Fluid flow in this direction is restricted only by the cross sections of the vent 126 and nozzle 128.

In contrast, combustion gasses flowing in the direction of the flow arrows shown in FIG. 3B first pass through the nozzle 128, thereby entering the vortex chamber 122 tangentially to the circular peripheral wall 124. As such, the fluid is forced to spiral, creating a vortex prior to exiting through the vent 126. As is evident from FIG. 3B, the circular shape of the vortex chamber 122 provides an angular acceleration to the tangentially flowing fluid. The resultant angular velocity of the fluid causes the formation of the vortex within the vortex chamber 122, thereby restricting the exit flow of the fluid through the vent 126.

As shown in FIG. 2A, one or more vortex diodes 120 are disposed within the silencer 110*a* such that the vortex chamber 122 is in fluid communication with the projectile path 119 by way of the vent 126 and the expansion chamber 134*a* by way of the nozzle 128. Therefore, during the firing of a projectile 104 from a weapon 100, combustion gases will be allowed to freely expand into the expansion chamber 134*a* by flowing through the vent 126, through the vortex chamber 122, and out the nozzle 128, as previously discussed with regard to FIG. 3A. For example, as shown in FIG. 2A, as the projectile 104 is urged along the projectile path 119 by the expanding combustion gases 106, the projectile 104 will eventually reach a location within the silencer 110*a* where the combustion gases 106 are allowed to pass through the vortex diodes 120 with minimal resistance and into the expansion chamber 134*a*.

To facilitate the flow of gases into the expansion chamber 134*a*, a pressure bleed port or ports (not shown) can be positioned toward the distal end 116, thereby removing any "block-loaded" pressure condition and reducing the input impedance of gases into the chamber 134*a*. An exemplary port could be a simple hole or could also be a vortex diode that will change resistance significantly when the chamber begins to become pressurized. The port would also facilitate the purging of water from the silencer 100*a* after submersion or cleaning. Another possible location for such a pressure bleed port could be between adjacent chambers 134*a*, should there be more than one, with the fluid communication path eventually leading to the discharge part 118.

Once the combustion gases 106 have passed into the expansion chamber 134*a*, the pressures within the weapon 102 and the silencer 110*a* represented by P1, P2, P3, and P4 are substantially equal and greater than the ambient pressure represented by P5. Note however, although greater than ambient pressure P5, those pressures represented by P1 through P4 are substantially less than the pressure exhibited by combustion gases leaving the barrel 102 of a weapon 100 when the silencer 110*a* is not used.

As shown in FIG. 2B, as the projectile 104 leaves the silencer 110*a* and the pressures P1 and P4 approach ambient pressure P5, pressures P2 and P3 are now greater than pressures P1 and P4. As such, the higher pressure combustion gases present in the expansion chamber 134*a* will flow to the lower pressure region represented by pressures P1 and P4 by flowing through the vortex diodes 120. Each vortex diode 120 now slows the depressurization of the expansion chamber 134*a* by inducing a vortex, represented by flow arrows 136, on the combustion gases as they flow first through the nozzle 128, tangentially about the vortex chamber 122, and eventually to the atmosphere through the vent 126 and then the discharge opening 118. As such, each vortex diode 120 not only aids in reducing the peak pressure of the combustion gases released to atmosphere, but also delays the depressurization of the expansion chamber 134*a*, thereby reducing the muzzle blast of the weapon being discharged. Additional versions of vortex diodes and chamber combinations can be placed within the same silencer for successive pressure drops.

Figure 5:
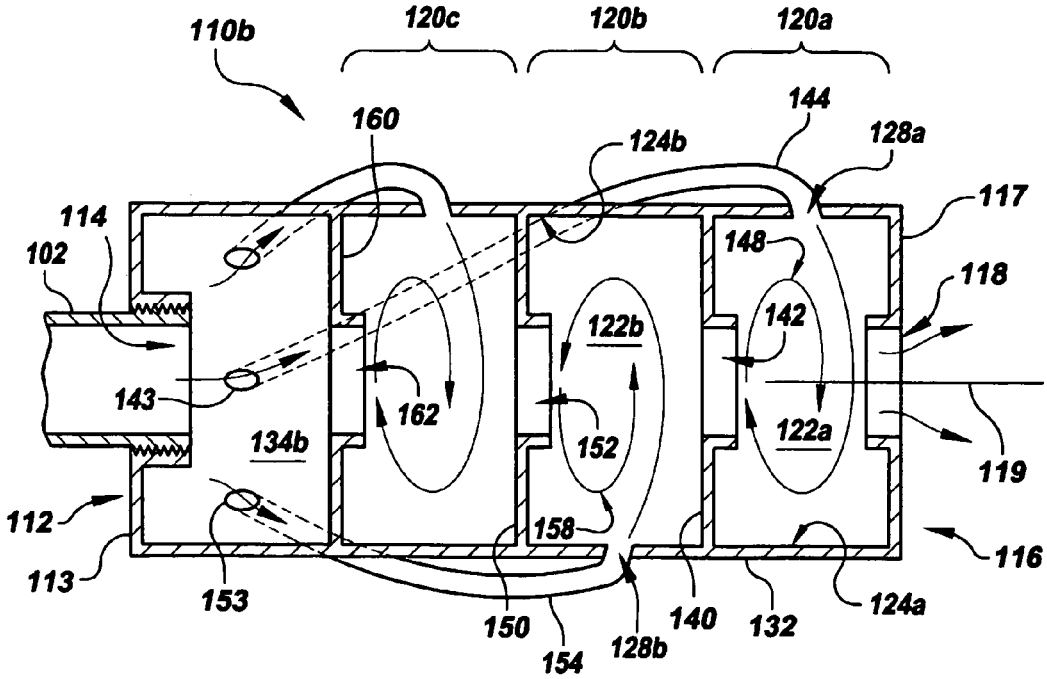
FIG. 5 is a cut-away side view of another embodiment of a silencer.

FIG. 5 depicts another embodiment of a silencer 110*b*. Preferably, the silencer 110*b* includes a proximal end 112 and a distal end 116. The proximal end is formed by a first wall 113 including an entry opening 114, and the distal end is formed by a second wall 117 including a discharge opening 118. The entry opening 114 and discharge opening 118 are both disposed about the projectile path 119. A cylindrical outer housing 132 extends from the first wall 113 to the second wall 117 about the projectile path 119, such that the silencer 110*b* forms a preferably cylindrical volume. As shown, the silencer 110*b* includes a first vortex diode 120*a*, a second vortex diode 120*b*, and a third vortex diode 120*c*. Note, embodiments of the silencer 110*b* are envisioned that include as few as one vortex diode 120, as well as numbers of vortex diodes 120 greater than that shown. For ease of description, only the operation of first vortex diode 120*a* and second vortex diode 120*b* will be discussed.

As shown, the first vortex diode 120*a* includes a vortex chamber 122*a* formed by the second wall 117, a first partition 140, and a circular peripheral wall 124*a*. The circular peripheral wall 124*a* is preferably the inner surface of the outer housing 132. The first vortex diode 120*a* also includes a nozzle 128*a* configured to introduce combustion gases tangentially to the circular peripheral wall 124*a*, and a vent, the function of which is performed by the discharge opening 118 of the second wall 117. Similarly, the second vortex diode 120*b* is formed between the first partition 140 and a second partition 150, and includes a circular peripheral wall 124*b* and a nozzle 128*b* for introducing combustion gases tangential to the circular peripheral wall 124*b*. Note, the dimensions of the various vortex chambers do not need to be uniform with respect to other vortex chambers within the same silencer.

A first projectile aperture 142 formed in the first partition 140 functions as the vent for the second vortex diode 120*b*. A third vortex diode 120*c* is similarly formed between a third partition 160 and the second partition 150. The first projectile aperture 142, the second projectile aperture 152, and a third projectile aperture 162 formed in the third partition 160 are all disposed along and about the projectile path 119. The inside diameters of projectile apertures 142, 152, and 162 exceed the projectile's outside diameter to ensure the projectile travels through the apertures without contact, but with minimal clearance to improve the effectiveness of the silencer As shown, the proximal end 112 of the silencer 110*b* includes an expansion chamber 134*b* formed between the third partition 160, the first wall 113, and a portion of the outer housing 132. As shown, the expansion chamber 134*b* is a cylindrical volume, although this is not necessary for all embodiments. Preferably, a first fluid conduit 144 extends from an inlet 143 in the outer wall of the expansion chamber 134*b* to the nozzle 128*a* of the first vortex diode 120*a*. Note, the first fluid conduit 144 does not need to be outside the silencer 110*b*, as shown. Rather, the fluid conduit 144 could be fashioned to conduct flows internal to the outer housing 132 in voids created by walls 124*a,b,c* (not shown). Similarly, a second conduit 154 extends from an inlet 153 formed in the outer wall of the expansion chamber 134*b* to the nozzle 128*b* of the second vortex diode 120*b*. The first and second conduits 144, 154 allow combustion gases, as indicated by the flow arrows, to flow from the expansion chamber 134*b* to their respective vortex diodes 120*a*, 120*b*.

After the weapon has been fired, the projectile (not shown) will eventually reach the vicinity of the third projectile aperture 162. At this point, the combustion gases that have propelled the projectile out of the barrel 102 pass into the expansion chamber 134*b* where at least a portion of the combustion gases exit through first and second inlets 143, 153 and travel down the first and second conduits 144, 154 into the first and second vortex diodes 120*a*, 120*b*, respectively. The combustion gases that reach the first vortex diode 120*a* are introduced to the vortex chamber 122*a* tangentially to the circular peripheral wall 124*a*. As such, a first vortex 148 is induced, thereby delaying the escape of the combustion gases from the silencer 110*b* by way of the discharge opening 118. Similarly, the combustion gases that reach the second vortex chamber 122*b* are introduced tangentially to the circular peripheral wall 124*b* through nozzle 128*b*, thereby forming a second vortex 158. Thus, the escape of the combustion gases through the first projectile aperture 142, and ultimately to the atmosphere, is delayed. Note, embodiments of the silencer 110*b* are envisioned wherein the conduits pass through the various partitions to their respective vortex diodes rather than being external to the outer housing 132. Additional internal helical baffles (not shown) can optionally be added to the proximal and distal ends of each vortex chamber to initiate swirl to the expanding gases prior to any additional circulation being induced by the nozzles. These baffles could be configured similar to turbine blade shapes that redirect the expanding fluids in the same direction of the induced swirl of the vortex diode.

Figure 6:
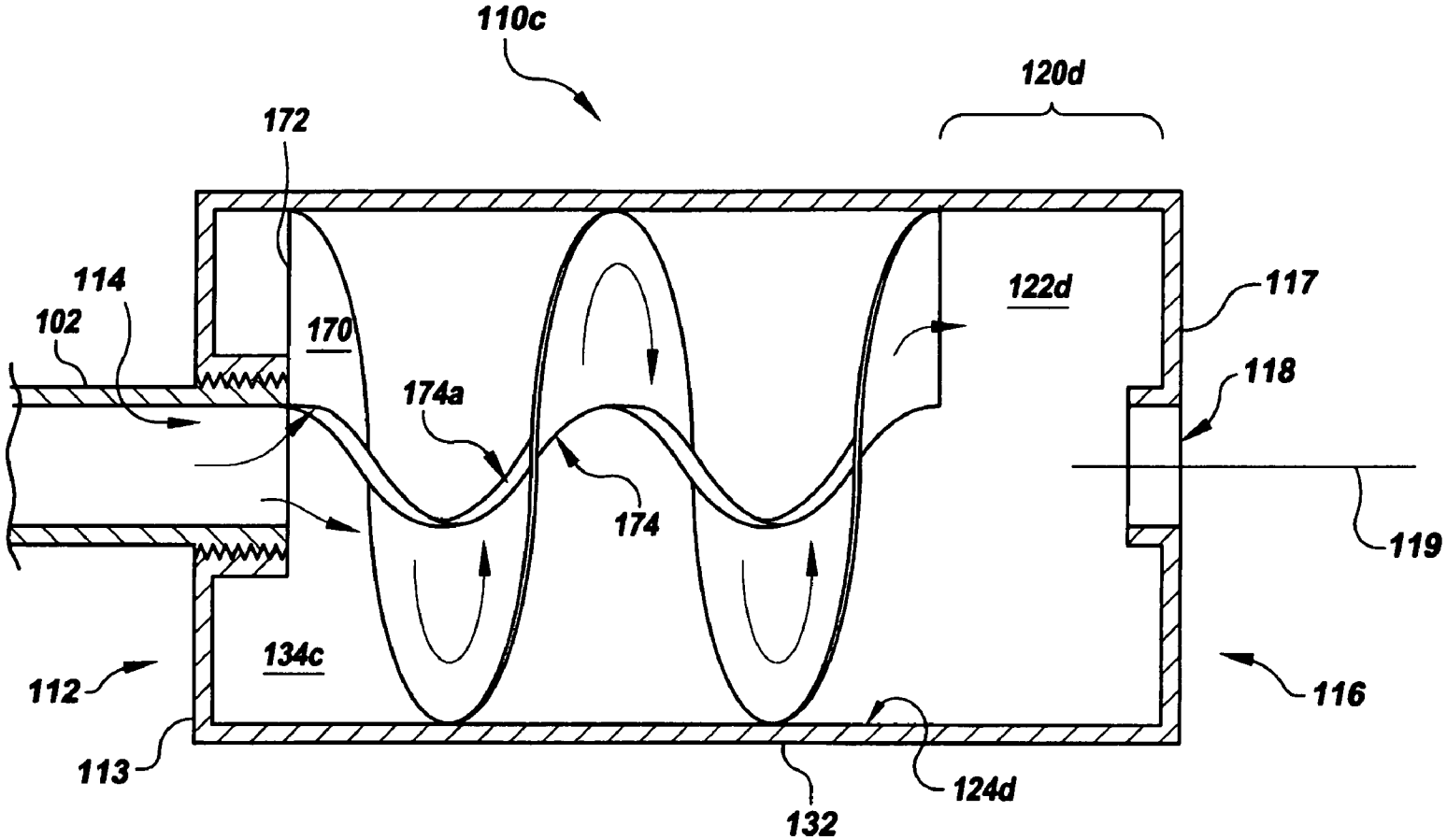
FIG. 6 is a cut-away side view of another embodiment of a silencer.

Another embodiment of a silencer 110*c* is depicted in FIG. 6. As shown, the silencer 110*c* includes a proximal end 112 and a distal end 116, the proximal end being formed by a first wall 113 including an entry opening 114, and the distal end being formed by a second wall 117 including a discharge opening 118. A cylindrical outer housing 132 extends from the first wall 113 to the second wall 117, thereby forming a cylindrical expansion chamber. The entry opening 114, the discharge opening 118, and the outer housing 132 are disposed about the projectile path 119. As shown, the silencer 110*c* also includes a helically-shaped baffle 170 extending from the proximal end 112 for a portion of the length of the silencer 110*c*. The helically-shaped baffle 170 contacts the first wall 113. However, the helically-shaped baffle 170 can be spaced from the first wall 113 in other embodiments. Preferably, the induced swirl of the combustion gases caused by the baffle should be in the same direction as the rifling of the weapon to reduce potential de-stabilizing effects of the gases on the projectile. However, this is not necessary.

The silencer 110*c* functions under the vortex diode flow principles previously described to reduce the amplitude of the sound of firing a weapon. In the embodiment shown, a vortex diode 120*d* includes a vortex chamber 122*d* formed by the cylindrical volume of the silencer 110*c*, a circular peripheral wall 124*d* formed by the inner surface of the outer housing 132, and a vent as formed by the discharge opening 118. The function of a nozzle is performed by the helically-shaped baffle 170. As a projectile exits the barrel 102 of the weapon, the combustion gases enter the vortex chamber 122*d* of the vortex diode 120*d*, where they encounter the helically-shaped baffle 170. Preferably, the helically-shaped baffle 170 includes an outer edge 172 that is in contact with the circular peripheral wall 124*d* and an inner edge 174 which is adjacent the projectile path 119.

Preferably, the inner edge 174 has an edge extension 174*a* that extends slightly in the direction toward the proximal end 112, whereby the edge extension 174*a* helps capture the expanding gases and force containment and circulation outward along the helical baffle 170. As the combustion gases encounter the helically-shaped baffle 170, an angular acceleration is imparted on the combustion gases, causing the gases to flow outwardly toward the circular peripheral wall 124*d*. As such, as the combustion gases travel the length of the vortex chamber 122*d*, a vortex is induced, as shown by the flow arrows. Therefore, the helically-shaped baffle 170 has performed the function of a nozzle 128 (FIGS. 3A–3B) by inducing a vortex on the combustion gases. Similar to the prior discussions, the induced vortex will contain the gases within the chamber 122*d* due to outwardly expanding circular swirl and delay the escape of the expanding combustion gases to atmosphere, thereby reducing the sound of the weapon being fired.

Figure 7:
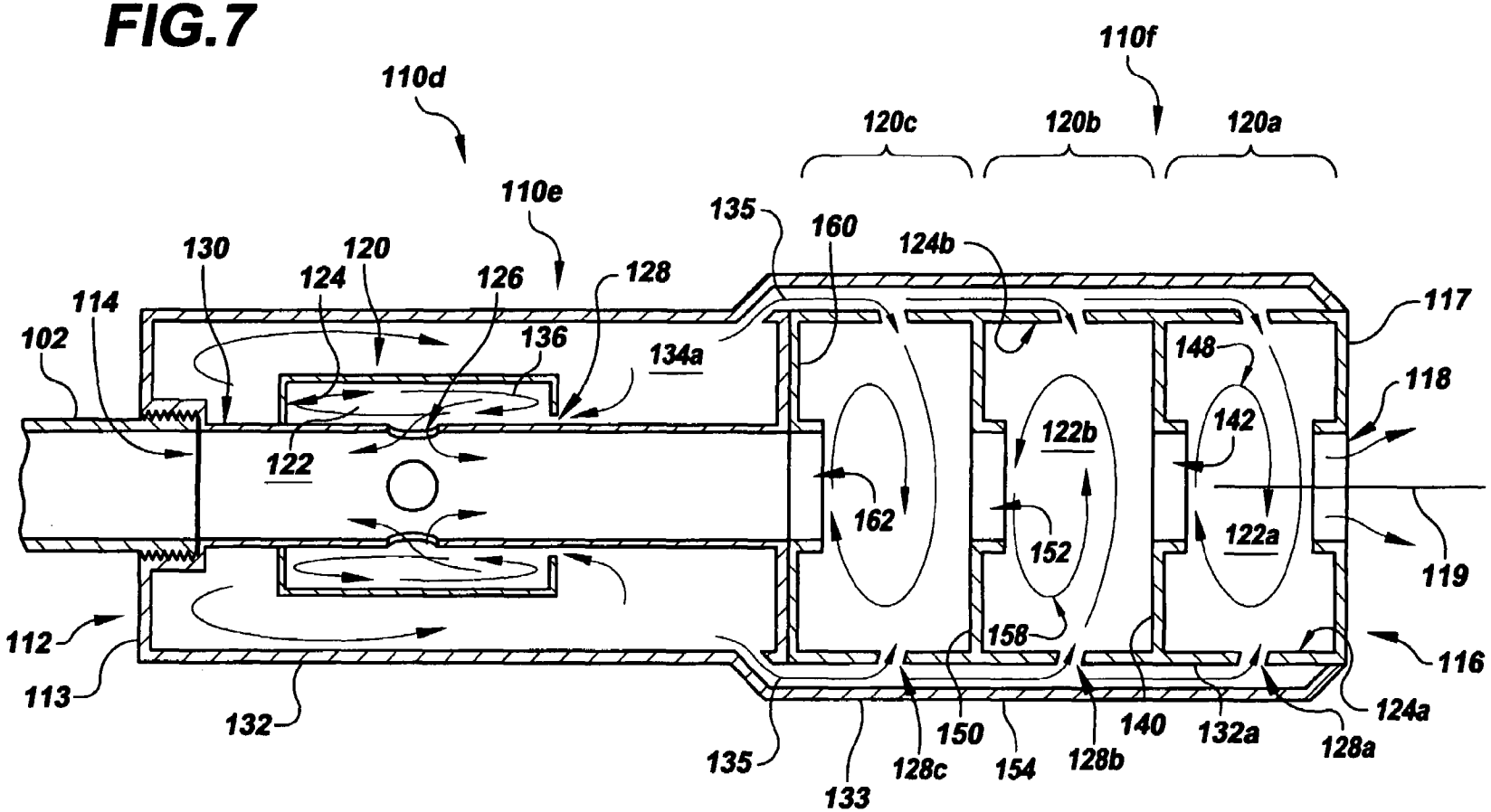
FIG. 7 is a cut-away side view of another embodiment of a silencer.

FIG. 7 depicts another embodiment of a silencer 110*d*. As shown, the silencer 110*d* includes a proximal end 112 including an entry opening 114, and a distal end 116 including a discharge opening 118. Preferably, the proximal end 112 is configured to be removably attached to the end of the barrel of a weapon, such as barrel 102. By way of example, matching threads are preferably used. The longitudinal axis of the barrel 102 and the silencer 110*d* form a single longitudinal axis, or projectile path 119. As shown, the silencer 110*d* includes a first stage 110*e* that functions similarly to the silencer 110*a* shown in FIGS. 2A–2B and 4, and a second stage 110*f* that functions similarly to the silencer 110*b* shown in FIG. 5. Note, however, that in the embodiment shown in FIG. 7, expansion chamber 134*b* has been replaced with the first stage 110*e*.

Preferably, an inner cylindrical wall 130 of the first stage 110*e* extends from the entry opening 114 to a third projectile aperture 162 formed in a third partition 160 of the second stage 110*f*. An outer housing 132*a* is disposed about the inner cylindrical wall 130, thereby forming an expansion chamber 134*a*.

Preferably, the first stage 110*e* includes a plurality of vortex diodes 120 disposed on the inner cylindrical wall 130 (FIG. 4). Each vortex diode 120 includes a circular peripheral wall 124 defining a substantially cylindrical vortex chamber 122, a vent 126, and a nozzle 128 formed in the circular peripheral wall 124. Embodiments are envisioned wherein multiple nozzles 128 are positioned at various points around the circular peripheral wall 124, each providing a tangential input to the chamber.

Preferably one or more vortex diodes 120 are disposed within the first stage 110*e* such that the vortex chamber 122 is in fluid communication with the projectile path 119 by way of the vent 126 and the expansion chamber 134*a* by way of the nozzle 128. Therefore, during the firing of a projectile from a weapon, combustion gases will be allowed to freely expand into the expansion chamber 134*a* by flowing through the vent 126, through the vortex chamber 122, and out the nozzle 128, as previously discussed with regard to FIG. 3A. As the projectile is urged along the projectile path 119 by the expanding combustion gases 106, the projectile will eventually reach a point within the first stage 110*e* where the combustion gases 106 are allowed to pass through the vortex diodes 120 with minimal resistance and into the expansion chamber 134*a*.

Preferably, the second stage 110*f* of the silencer 110*d* includes a cylindrical outer housing 132 extending from the third partition 160 to the second wall 117, a first axially-disposed vortex diode 120*a*, a second axially-disposed vortex diode 120*b*, and a third axially-disposed vortex diode 120*c*. Note, embodiments of the silencer 110*d* are envisioned that include as few as one axially-disposed vortex diode 120*a–c*, as well as numbers of vortex axially-disposed diodes 120*a–c* greater than that shown. For ease of description, only the operation of first axially-disposed vortex diode 120*a* and second vortex diode 120*b* will be discussed.

As shown, the first axially-disposed vortex diode 120*a* includes a vortex chamber 122*a* formed by the second wall 117, a first partition 140 and a circular peripheral wall 124*a*. Preferably, the circular peripheral wall 124*a* is the inner surface of the outer housing 132. The first vortex diode 120*a* also includes at least one nozzle 128*a* configured to introduce combustion gases tangentially to the circular peripheral wall 124*a*, and a vent, the function of which is performed by the discharge opening 118 of the second wall 117. Similarly, the second vortex diode 120*b* is formed between the first partition 140 and a second partition 150, and includes a circular peripheral wall 124*b* and at least one nozzle 128*b* for introducing combustion gases tangential to the circular peripheral wall 124*b*. Note, the dimensions of the various vortex chambers do not need to be uniform with respect to other vortex chambers within the same silencer.

A first projectile aperture 142 formed in the first partition 140 functions as the vent for the second vortex diode 120*b*. A third vortex diode 120*c* is similarly formed between a third partition 160 and the second partition 150. The first projectile aperture 142, the second projectile aperture 152, and a third projectile aperture 162 formed in the third partition 160 are all disposed along and about the projectile path 119. The inside diameters of projectile apertures 142, 152, and 162 exceed the projectile's outside diameter to ensure the projectile travels through the apertures without contact, but with minimal clearance to improve the effectiveness of the silencer 10*b*.

Control ports 135 bleed a portion of high pressure air from the expansion chamber 134*a* to a volume formed between the outer housing 132*a* and a second housing 133. As indicated by the flow arrows, combustion gases are allowed to flow from the expansion chamber 134*a* to the axially-disposed vortex diodes 120*a–c* by way of the volume and the nozzles 128*a–c*.

The combustion gases that reach the first vortex diode 120*a* are introduced to the vortex chamber 122*a* tangentially to the circular peripheral wall 124*a*. As discussed in regard to FIG. 3B, a first vortex 148 is induced, thereby delaying the escape of the combustion gases from the silencer 110*d* by way of the discharge opening 118. Similarly, the combustion gases that reach the second vortex chamber 122*b* are introduced tangentially to the circular peripheral wall 124*b* through nozzle 128*b*, thereby forming a second vortex 158. The escape of the combustion gases through the first projectile aperture 142, and ultimately to the atmosphere, is delayed.

As the projectile 104 leaves the silencer 110*d* the higher pressure combustion gases remaining in the expansion chamber 134*a* will flow to the lower pressure region along the flight path by flowing through the vortex diodes 120 of the first stage 110*e*. Each vortex diode 120 now slows the depressurization of the expansion chamber 134*a* by inducing a vortex, represented by flow arrows 136, on the combustion gases as they flow first through the nozzle 128, tangentially about the vortex chamber 122, and eventually to the atmosphere through the vent 126 and then the discharge opening 118. As such, each vortex diode 120 not only aids in reducing the peak pressure of the combustion gases released to atmosphere, but also delays the depressurization of the expansion chamber 134*a*, thereby reducing the muzzle blast of the weapon being discharged.

Note, although the silencers that have been disclosed are for use in reducing the muzzle blast of a weapon, similar devices operating on similar principles can be used to quiet exhausting of high pressure fluids (gases, liquids, gas/liquid combinations, etc.) in industrial equipment, engines, vehicle mufflers, and other manufacturing equipment.

The foregoing description has been presented for purposes of illustration and description. It is not intended to be exhaustive or to limit the present disclosure to the precise forms disclosed. Modifications and/or variations are possible in light of the above teachings. The embodiments discussed, however, were chosen and described to illustrate the principles of the present disclosure and its practical application to thereby enable one of ordinary skill in the art to utilize the present disclosure and various embodiments and with various modifications as are suited to the particular use contemplated. All such modifications and/or variations are within the scope of the present disclosure as determined by the appended claims when interpreted in accordance with the breadth to which they are fairly and legally entitled.

What is claimed is:

1. A silencer for a weapon having a combustion chamber and a barrel, the weapon being configured to launch a projectile with combustion gases generated in the combustion chamber, the silencer comprising:

a proximal end and a distal end, the proximal end being configured for mounting the silencer to the barrel and including an entry opening, the distal end including a discharge opening configured to allow the projectile to pass therethrough, the entry opening and discharge opening being concentric about a longitudinal axis of the barrel and defining a projectile path therebetween;

an inner cylindrical wall disposed about the projectile path;

an outer housing disposed concentrically about the inner cylindrical wall;

an expansion chamber formed by the inner cylindrical wall, the outer housing, the proximal end and the distal end of the silencer; and at least one vortex chamber disposed between the proximal end and the distal end, the at least one vortex chamber including:

a vent disposed on the inner cylindrical wall;

a circular peripheral wall being disposed concentrically about the vent;

a nozzle disposed on the circular peripheral wall; and wherein the circular peripheral wall is operative to induce a vortex on at least a portion of the combustion gases expelled from the combustion chamber during launch of the projectile, the vortex impeding flow of the combustion gases from the barrel such that the acoustic energy associated with the launch of the projectile is dissipated.

2. A silencer for a weapon having a combustion chamber and a barrel, the weapon being configured to a projectile with combustion gases generated in the combustion chamber, the silencer comprising:

a proximal end and a distal end, the proximal end being configured for mounting the silencer to the barrel, the distal end being configured to allow the projectile to pass therethrough;

an entry opening disposed on the proximal end of the silencer;

a discharge opening disposed on the distal end of the silencer wherein the entry opening and discharge opening are located along a longitudinal axis of the barrel and define a projectile path therebetween;

an inner cylindrical wall disposed about the projectile path;

an outer housing disposed about the inner cylindrical wall;

an expansion chamber formed by the inner cylindrical wall, the outer housings, the proximal end and the distal end of the silencer;

at least one vortex chamber disposed between the proximal end and the distal end, the at least one vortex chamber including a circular peripheral wall for inducing a vortex on at least a portion of the combustion gases expelled from the combustion chamber during launch of the projectile, the vortex impeding flow of the combustion gases from the barrel such that acoustic energy associated with the launch of the projectile is dissipated;

wherein the at least one vortex chamber further comprises a first vortex chamber, in fluid communication with both the projectile path and the expansion chamber;

further comprising a vent disposed on the inner cylindrical wall, the circular peripheral wall being disposed concentrically about the vent, the vent being configured to allow combustion gases to flow between the vortex chamber and the projectile path, and a nozzle disposed on the circular peripheral wall, wherein the nozzle is configured to introduce a first portion of the combustion gases into the first vortex chamber tangentially to the circular peripheral wall.

3. The silencer of claim 2, wherein a central longitudinal axis of the first vortex chamber is perpendicular to the projectile path.

4. A weapon for launching a projectile with combustion gases, comprising:

a combustion chamber;

a barrel for guiding the projectile along a flight path; and a silencer comprising:

a proximal end and a distal end, the proximal end being configured for mounting the silencer to the barrel, the distal end being configured to allow the projectile to pass therethrough;

at least one vortex chamber disposed between the proximal end and the distal end, the at least one vortex chamber including a circular peripheral wall for inducing a vortex on at least a portion of the combustion gases expelled from the combustion chamber during launch of the projectile, the vortex impeding flow of the combustion gases from the barrel such that acoustic energy associated with the launch of the projectile is lessened;

an entry opening disposed on the proximal end of the silencer;

a discharge opening disposed on the distal end of the silencer wherein the entry opening and discharge opening are located along a longitudinal axis of the barrel and define a projectile path therebetween;

an inner cylindrical wall disposed about the projectile path;

an outer housing disposed about the inner cylindrical wall;

an expansion chamber formed by the inner cylindrical wall, the outer housing, the proximal end and the distal end of the silencer;

wherein the at least one vortex chamber further comprises a first vortex chamber in fluid communication with both the projectile path and the expansion chamber; and a vent disposed in the inner cylindrical wall, the circular peripheral wall being disposed concentrically about the vent, the vent being configured to allow combustion gases to flow between the vortex chamber and the projectile path, and a nozzle disposed on the circular peripheral wall, wherein the nozzle is configured to introduce a first portion of the combustion gases into the first vortex chamber tangentially to the circular peripheral wall.

5. A weapon for launching a projectile with combustion gases, comprising:

a combustion chamber;

means for guiding the projectile along a flight path; and means for silencing the weapon comprising:

a proximal end and a distal end, the proximal end being configured for mounting to the barrel, the distal end being configured to allow the projectile to pass therethrough;

a means for venting gas into an expansion chamber; and means disposed concentrically about the vent means for including a circular peripheral wall for inducing a vortex on at least a portion of the combustion gases expelled from the combustion chamber into the expansion chamber during launch of the projectile.

* * * * *